US005850932A

United States Patent [19]

Beck et al.

[11] Patent Number: 5,850,932

[45] Date of Patent: Dec. 22, 1998

[54] BASE DESIGN FOR ONE PIECE SELF-STANDING BLOW MOLDED PLASTIC CONTAINERS

[75] Inventors: Martin H. Beck; George F. Rollend, both of Amherst; Robert Caldicott, Nashua; Dennis C. Connor, Merrimack, all of N.H.

[73] Assignee: DTL Monofoot Limited Partnership, Amherst, N.H.

[21] Appl. No.: 889,059

[22] Filed: Jul. 7, 1997

[51] Int. Cl.[6] ..... B65D 90/12

[52] U.S. Cl. ..... 215/375; 220/606; 220/608

[58] Field of Search ..... 215/374, 375, 215/376, 377; 220/606, 608, 609, 635, 636

[56] References Cited

U.S. PATENT DOCUMENTS

| | | | |
|---|---|---|---|
| 4,249,667 | 2/1981 | Pocock et al. | 220/606 X |
| 4,294,366 | 10/1981 | Chang | 220/606 X |
| 4,780,257 | 10/1988 | Beck . | |
| 4,785,950 | 11/1988 | Miller et al. | 220/606 |
| 4,880,129 | 11/1989 | McHenry et al. | 220/609 |
| 4,889,752 | 12/1989 | Beck . | |
| 4,927,679 | 5/1990 | Beck . | |
| 5,024,339 | 6/1991 | Riemer | 220/606 X |
| 5,205,434 | 4/1993 | Brunson et al. | 220/606 X |
| 5,320,230 | 6/1994 | Hsiung | 215/375 |
| 5,353,954 | 10/1994 | Steward et al. | 215/375 X |
| 5,452,815 | 9/1995 | Hsiung | 220/609 X |
| 5,454,481 | 10/1995 | Hsu | 220/609 X |
| 5,484,072 | 1/1996 | Beck et al. | 220/609 X |
| 5,529,196 | 6/1996 | Lane | 220/609 X |
| 5,549,210 | 8/1996 | Cheng | 215/377 X |
| 5,603,423 | 2/1997 | Lynn et al. | 220/606 X |

*Primary Examiner*—Gary E. Elkins
*Assistant Examiner*—Tri M. Mai
*Attorney, Agent, or Firm*—Davis and Bujold

[57] ABSTRACT

The invention provides a light weight self-standing blow molded two-liter carbonated beverage container base design having a unique petaloid base. The base comprises a petaloid design which has a plurality of at least three (preferably five) feet with an ever increasing radius of curvature joining the feet to the underlying base from the radially outer portion of the feet to the radially inner portion of the feet, a controlled radius from the axis of the container to that curvature and an area of material flow in feet ankles and straps therebetween to promote adequate material flow during blow molding, to the radially outer most areas of the feet and straps.

18 Claims, 7 Drawing Sheets

BASE DESIGN FOR ONE PIECE SELF-STANDING BLOW MOLDED PLASTIC CONTAINERS

The present invention relates to a base design for plastic containers for containing fluids under pressure, more particularly, to a light weight petaloid base design.

BACKGROUND OF THE INVENTION

Blow molded plastic bottles have largely replaced the heavier glass bottles previously used for soft drinks, and the like. In a two liter bottle of plastic, the weight of the bottle itself is negligible as compared to the weight of a glass bottle of similar capacity. The first plastic bottles were generally two piece bottles comprising a pressure vessel portion typically of a tough, flexible plastic (e.g. polyester) which became resiliently rigid for gripping due to the internal pressure created by the carbon dioxide gas in the soft drink liquid contained therein. The bottom was hemispherical and the separate base was required in order for the bottle be able to stand by itself. The base was typically of a plastic such as polyethylene and is attached over the bottom of the pressure vessel portion with adhesive.

More recently, one piece bottle designs utilizing a petaloid base have been proposed.

In all polyester (usually PET) bottles, weight is a very important consideration. Based on a conservative estimate of 5 billion bottles produced per year and a PET price of $(US) 1.54 per Kg ($(US) 0.70 per pound), a 1–2 gram decrease in the PET content of a bottle will save approximately $(US) 7–14 million per year. Therefore reducing the weight of the bottle is important. However a weight reduction must be achieved without jeopardizing the structural integrity of the bottle and this is particularly problematic with the complex geometry of a petaloid base design.

OBJECT OF THE INVENTION

It is an object of the present invention to provide a design philosophy and construction for the base of a one piece plastic bottle for containing carbonated beverages which is of the petaloid type using less material than prior art designs.

SUMMARY OF THE INVENTION

According to the invention there is provided a self-standing polyester container for carbonated beverages defining a longitudinal axis and comprising a sidewall portion which is integral with an terminates in a closed base portion of a petaloid form defining an underlying base form with at least three feet depending therefrom and disposed about the longitudinal axis whereby the container is self standing, each said foot being defined by: i) a support pad; ii) a sloping outer wall extending generally upwardly from a radially outward extremity of the support pad to the sidewall portion; iii) sloping side walls extending generally upwardly from radially extending extremities of the support pad to a transition to radially extending straps disposed between adjacent pairs of feet, each said strap extending radially outwardly from a base area, centered on said longitudinal axis, along a curve to said sidewall portion; iv) a sloping inner wall extending from a radially inner extremity of the support pad to a junction with the base area; and, v) a blending concave curvatures located at the transition of said sidewalls and said straps and at the junction of the ankles and the base area, each curvature increasing in radius transversely of the curvature from a relatively small radius adjacent the sidewall portion to a relatively large radius at the junction of the ankle and base area.

Preferably each strap has a root portion coincident with said underlying base form extending throughout the length of the strap from the base area to the straps radially out extent from the longitudinal axis.

In a preferred form the container has five feet.

Also according to the invention there is provided a method of designing a self-standing polyester container for carbonated beverages defining a longitudinal axis and comprising a sidewall portion which is integral with and terminates in a closed base of a petaloid form having an underlying base form with at least three feet depending therefrom and disposed about the longitudinal axis whereby the container is self standing, each said foot being defined by: i) a support pad; ii) a sloping outer wall extending generally upwardly outward from a radially outward extremity of the support pad to the sidewall portion; iii) sloping side walls extending generally upwardly from radially extending extremities of the support pad each to a transition to a radially extending strap; each strap being disposed between adjacent pairs of feet and extending radially outwardly from a base area, centered on said longitudinal axis, along a curve toward said sidewall portion; iv) a sloping ankle extending from a radially inner extremity of the support pad to a junction with the base area; and, v) a blending concave curvatures located at the transition of each said sidewall and associated strap and at the junction of the ankles and the base area, each curvature increasing in radius transversely of the curvature from a relatively small radius adjacent the sidewall portion to a relatively large radius at the junction of the ankle and base area including the steps of: a) specifying base height H and major base diameter D, contact diameter CD, pushup P, width of foot pad wP and depth dP of the foot pad according to handling requirements and bottle specifications; b) defining $R_3$ an arc running tangent to the major diameter of the lower panel of the bottle, at the intersection of the lower panel and major base diameter, and ending at the foot pad near the contact diameter CD such that a fillet blending radii may run tangent to it and the foot pad; c) defining the straps of the container, with centerlines 36° from the center of the foot, in a five footed base, by three radii $R_1$, $R_2$, $R_3$ taken in a vertical section including the axis with $R_1$ calculated to amount to between 85%–125% of half the major diameter D, $R_1$ runs horizontally through the centerline of the pushup P of the base and proceeds upward to ward the major diameter D of the base, extension beyond the centerline of the pushup on the radially inner extension strap ending when vertical height $h_1$ above the pushup P is between 0.01 inches–0.05 inches; d) deriving $R_2$ by defining its tangent point with radius one $R_1$ and its end point at intersection with $R_3$, the tangent point being defined by vertical distance $h_2$ from the major diameter D and is a calculated value between 40%–80% of the difference between the height H and the pushup P; and e) assigning a horizontal radius rA from the longitudinal axis to the intersection of the ankle radius and rA is assigned a value between 0.2 inches and 0.5 inches, the intersection underlying the blending concave curvature.

BRIEF DESCRIPTION OF THE DRAWINGS

The invention will now be described, by way of example, with reference to the accompanying drawings, in which.

DETAILED DESCRIPTION OF THE INVENTION

Briefly, the base of the preferred form of the container of the present invention comprises a petaloid design for a bottle which has five feet evenly disposed around the longitudinal axis of the bottle and projecting from a modified hemispherical base form of the bottle to provide a stable self-standing support for the bottle. Between each adjacent pair of feet is a radially extending strap having a strap root that follows the modified hemispherical base shape and opens to an extended portion of that base shape lying radially outwardly of the feet.

Figure 1:
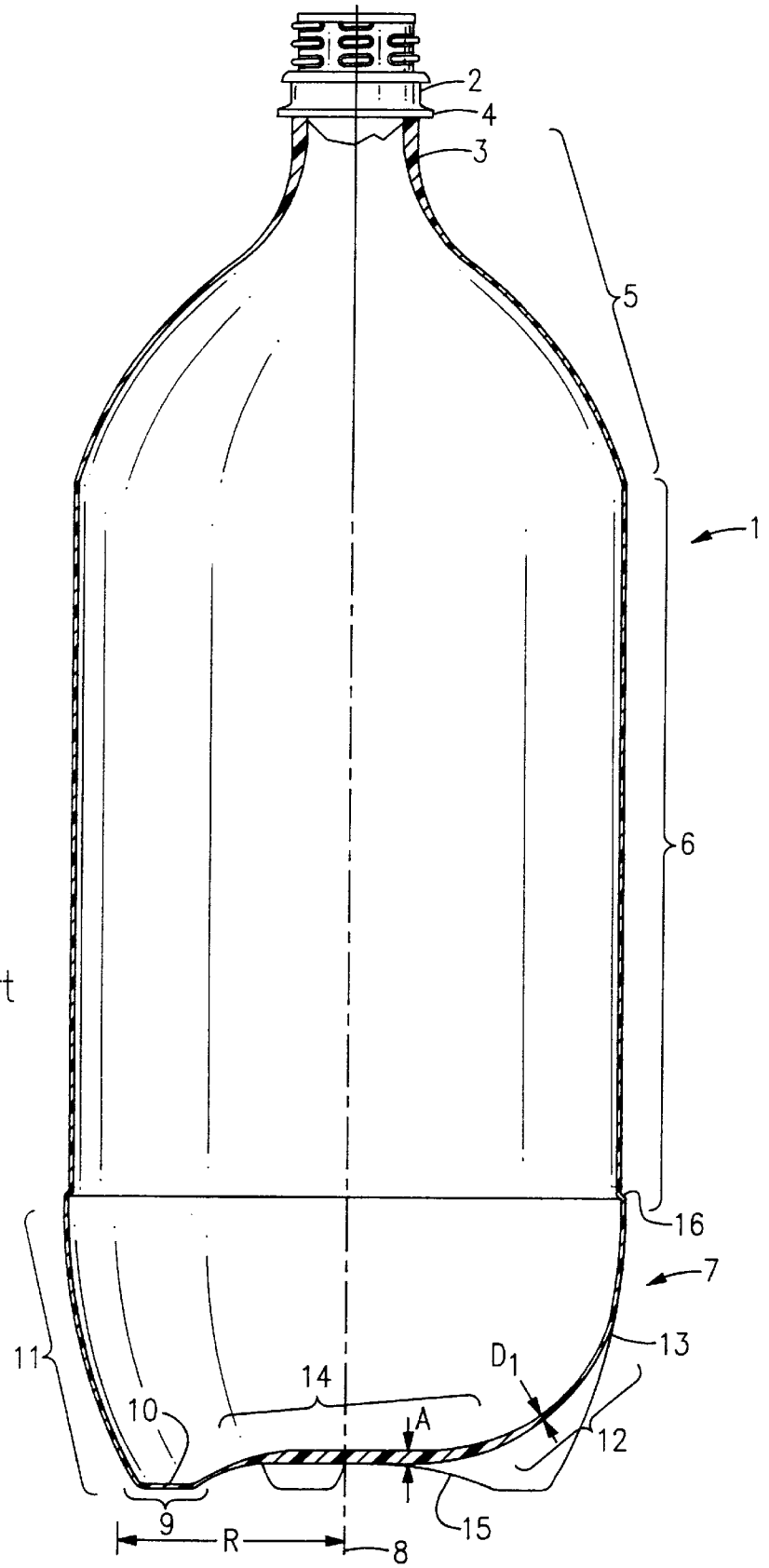
FIG.1 Prior Art
FIG. 1 is a partially sectioned view taken along line 1—1 of FIG. 2 of a prior art bottle having a petaloid base.
Figure 2:
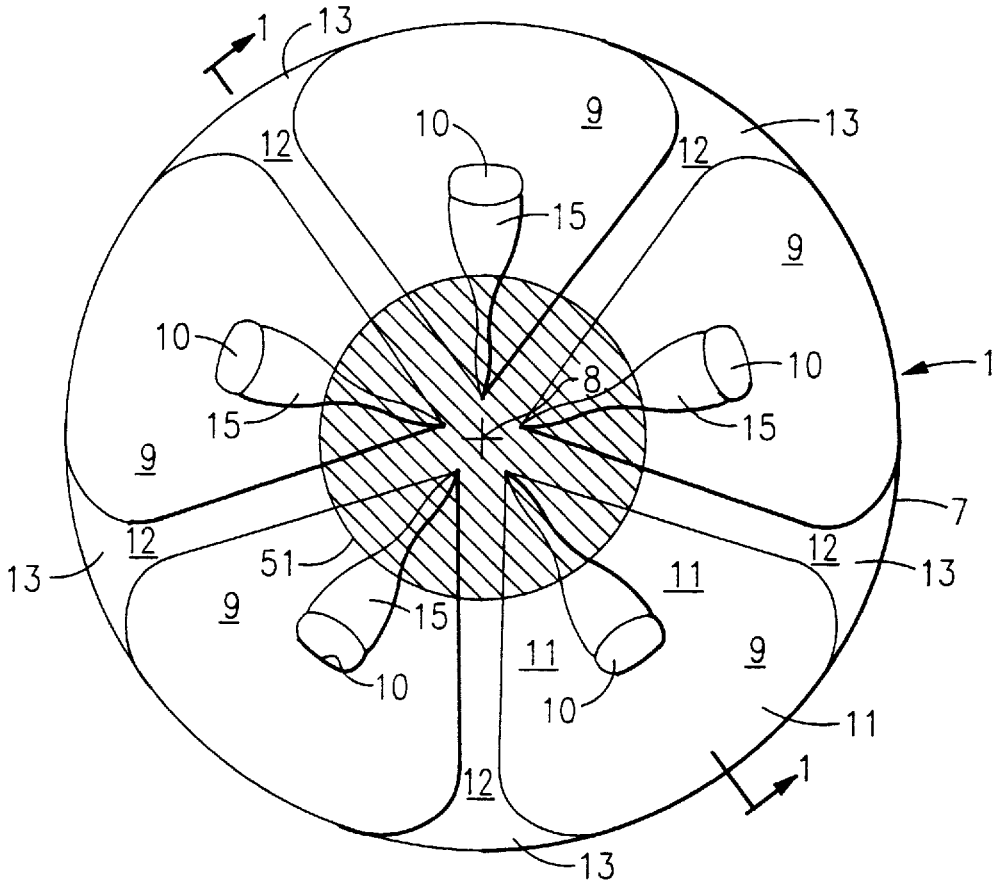
FIG.2 Prior Art
FIG. 2 is a bottom view of the petaloid base of a prior art bottle.
Figure 3:
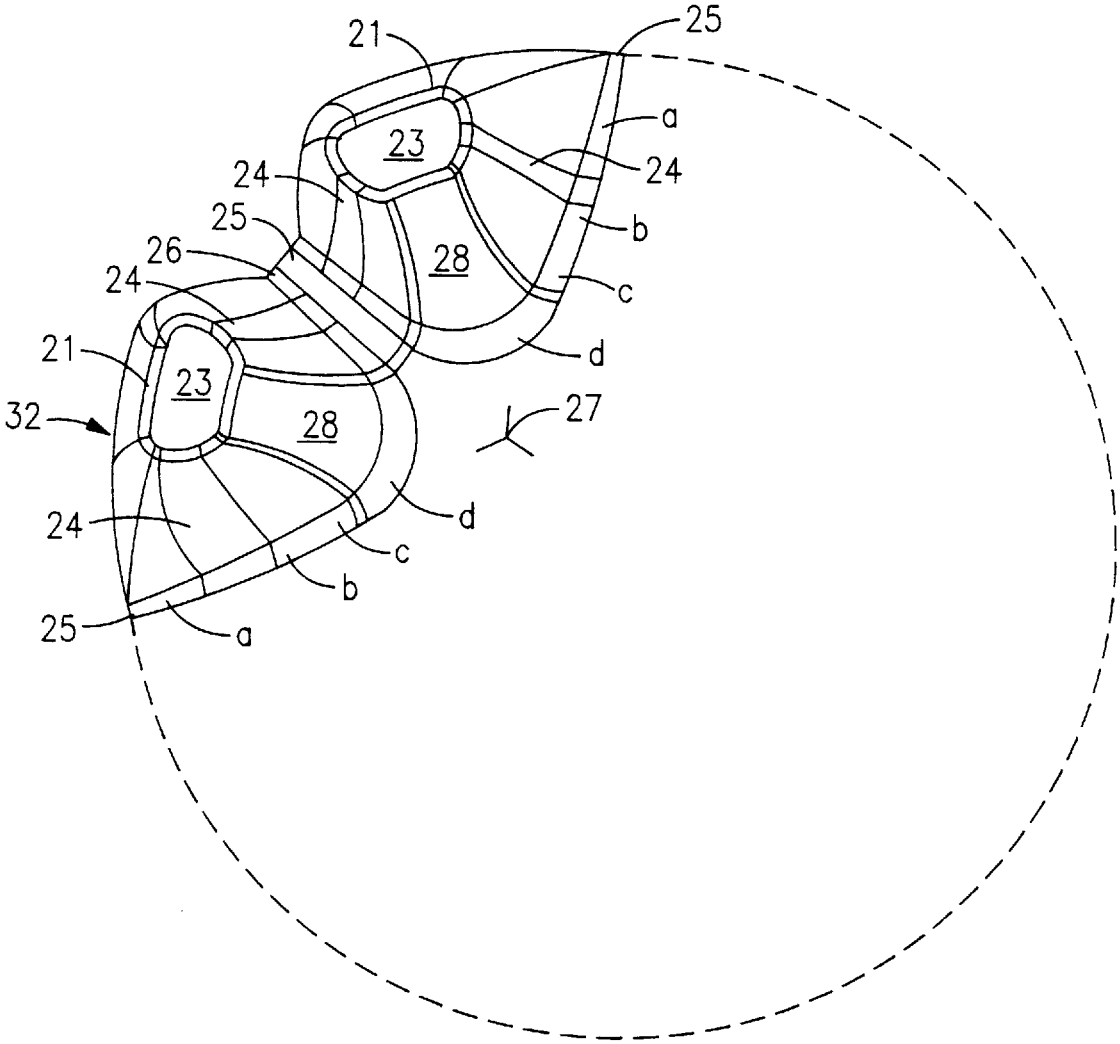
FIG. 3 is a three dimensional rendition of a petaloid base design of the present invention with three of its five feet omitted for clarity.

Referring first to FIGS. 1 and 2, a prior art one piece self-standing bi-axially oriented PET two liter bottle 1, of circular horizontal cross-section, comprises a neck finish 2 connected to a neck transition portion 3 by way of a neck support ring 4. The neck transition portion 3 connects by way of an upper portion 5 of the bottle to a substantially cylindrical sidewall portion 6 which terminates at its lower end in a closed base 7, the underlying shape of which is hemispherical. The bottle 1 defines a longitudinal axis 8.

Projecting downwardly from the hemispherical form of the base are five hollow feet 9 which together form a petaloid foot formation with the feet symmetrically and evenly disposed about the longitudinal axis 8 to provide the stable support for the bottle necessary to provide its self-standing ability. The lowest extensions of the feet 9 terminate in bottle support pads 10. Each foot 9 comprises sloping side walls 11 extending from its pad 10 to its junction with the underlying hemispherical formation (reference numbers for sloping walls 11 are included in FIG. 2 only with respect to one of the feet although all of the feet are identical).

Radially extending straps 12 are disposed between adjacent pairs of feet 9. These straps 12 each include a strap base which substantially follows the surface curvature of the underlying hemispherical shape of the base 7 and terminates at and opens into an extended portion 13 where the straps 12 meets the sloping wall 11. Although shown in FIG. 2 by solid lines, for simplicity at the junctions between the sloping walls 11 and the straps 12 and pads 10, the intersections of these elements are curved in cross-section to provide smooth transitions and structural rigidity of the straps along their length.

The gate area (push-up base area) 14 of the base 7, through which extends the axis 8 is connected to each pad 10 by a substantially flat ridge ankle 15 joined on either side to portions of the sloping walls 11.

The bottle illustrated includes a small annular lip 16 which is primarily present for aesthetic purposes and for label alignment during production. This lip lies adjacent the transition from the sidewall 6 to the base 7.

In the prior art bottle, as illustrated in FIG. 2, the base area of the base is thickened, as diagrammatically illustrated by shaded circle 51, in an attempt to strengthen the base and prevent rollout and inversion of the base portion. This solution is unsatisfactory because it significantly increases the amount of material required to form the base portion of the bottle, thereby undesirable increasing the weight and cost of the bottle.

Rollout of the base occurs when the internal pressurization of the bottle 7 causes the gate area 14 of the base to creep downwardly, with a circumferentially surrounding area pivoting about an area in or outside of the foot pads 10. By careful geometric design of the areas in and around the feet and by control of material flow during blow molding, the present invention prevents these areas from deforming undesirably upon pressurization of the bottle while permitting the use of less material in the base as compared with prior art designs.

As shown in FIG. 1, the transition from the extended portion 13 to the gate 14 is a smooth transition with increasing cross-sectional thickness. That is the thickness at "D1" is less than the thickness at "A".

With particular reference to FIG. 1, it will be noted that although the bottle is illustrated in cross-sectional form and although the material of the bottle will usually be substantially transparent, details of the interior of the bottles, lying beyond a cross-section taken, are omitted for the sake of clarity in the illustration of the invention.

Referring again to FIG. 1, the illustrated neck finish 2 connected to a neck transition portion 3 by way of a neck support ring 4 with the neck transition portion 3 connecting by way of an upper portion 5 of the bottle to a substantially cylindrical sidewall portion 6 which terminates at its lower end at a closed base 7 are to be taken as illustrative of corresponding features of the bottle of the present invention which terminates at its lower end in the petaloid base design.

The particular exemplary embodiment of the present invention is a petaloid base design in a one piece self-standing bi-axially oriented PET two liter bottle of circular cross-section.

Referring now to FIGS. 3, 4, 5 and 6, projecting downwardly from a modified hemispherical underlying form 20 of the base are five identical hollow feet 21 (see FIG. 5), which together form a petaloid foot formation with the feet symmetrically and evenly disposed about longitudinal axis 22 (see FIG. 6) to provide stable support for the bottle necessary to provide its self-standing ability. The lowest extensions of the feet 21 terminate in bottle support pads 23. The pads 23 together define a container support plane 42 disposed normal to the axis 22 (see FIG. 6). Each foot 21 comprises sloping side walls 24 extending from its pad 23 to adjacent straps 25 which generally conform to the underlying modified hemispherical form 20.

Figure 5:
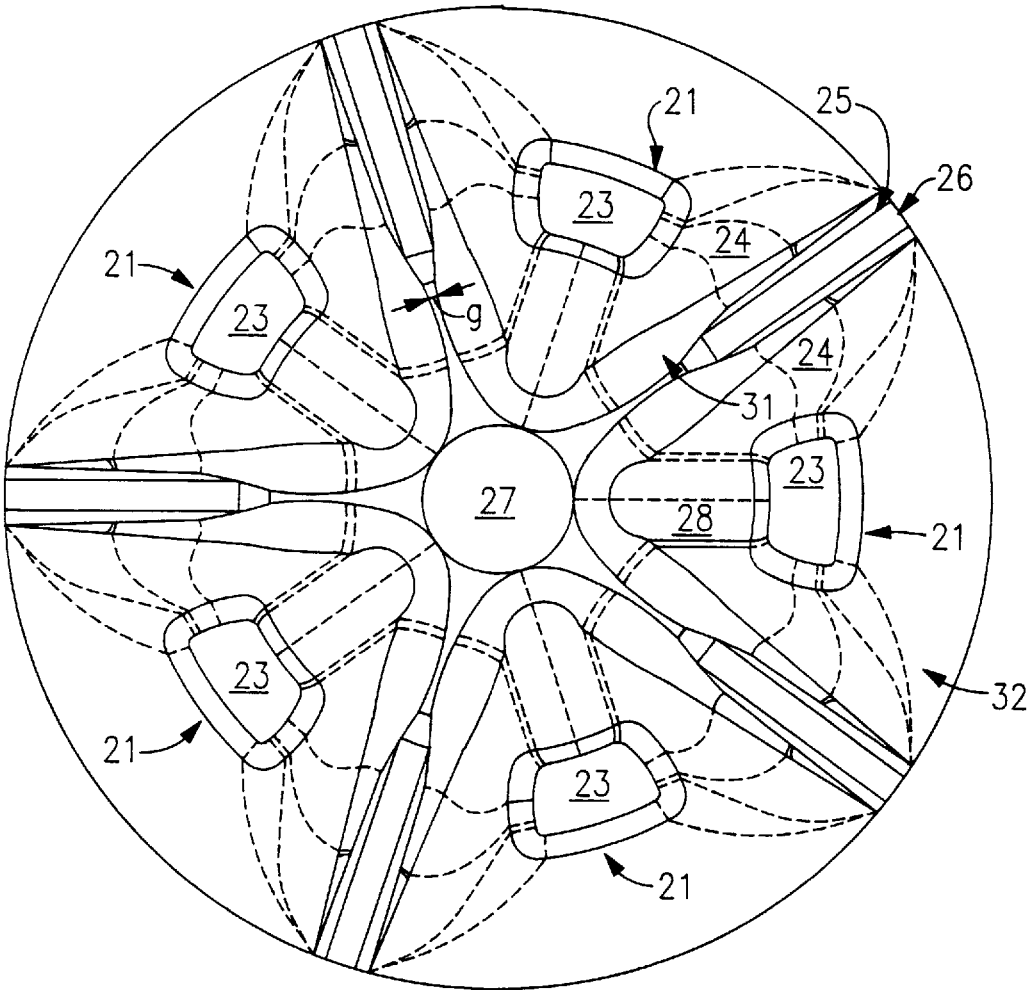
FIG. 5 is a bottom view of the present invention.
Figure 6:
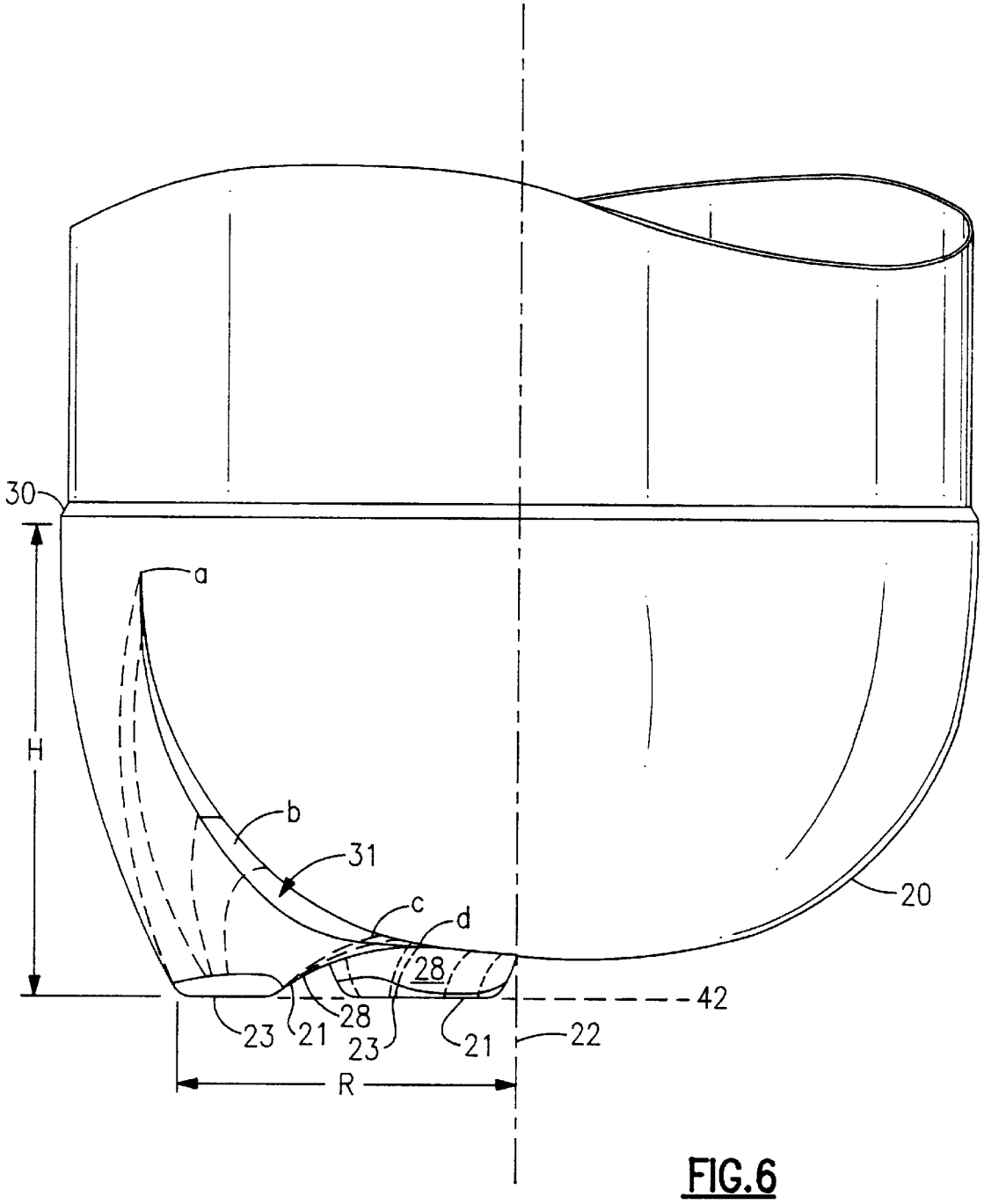
FIG. 6 is a diagrammatic elevation of the base as illustrated in FIGS. 3, 4 and 6.

The dashed lines in the feet 21 of FIGS. 5 and 6 indicate the theoretical underlying intersections of the surfaces defining the feet and the modified hemispherical shaped base. These intersections are theoretical due to the joining of the surfaces by smooth transitions, fillets or chamfers in order to define the curvature of the surfaces concerned.

Figure 4:
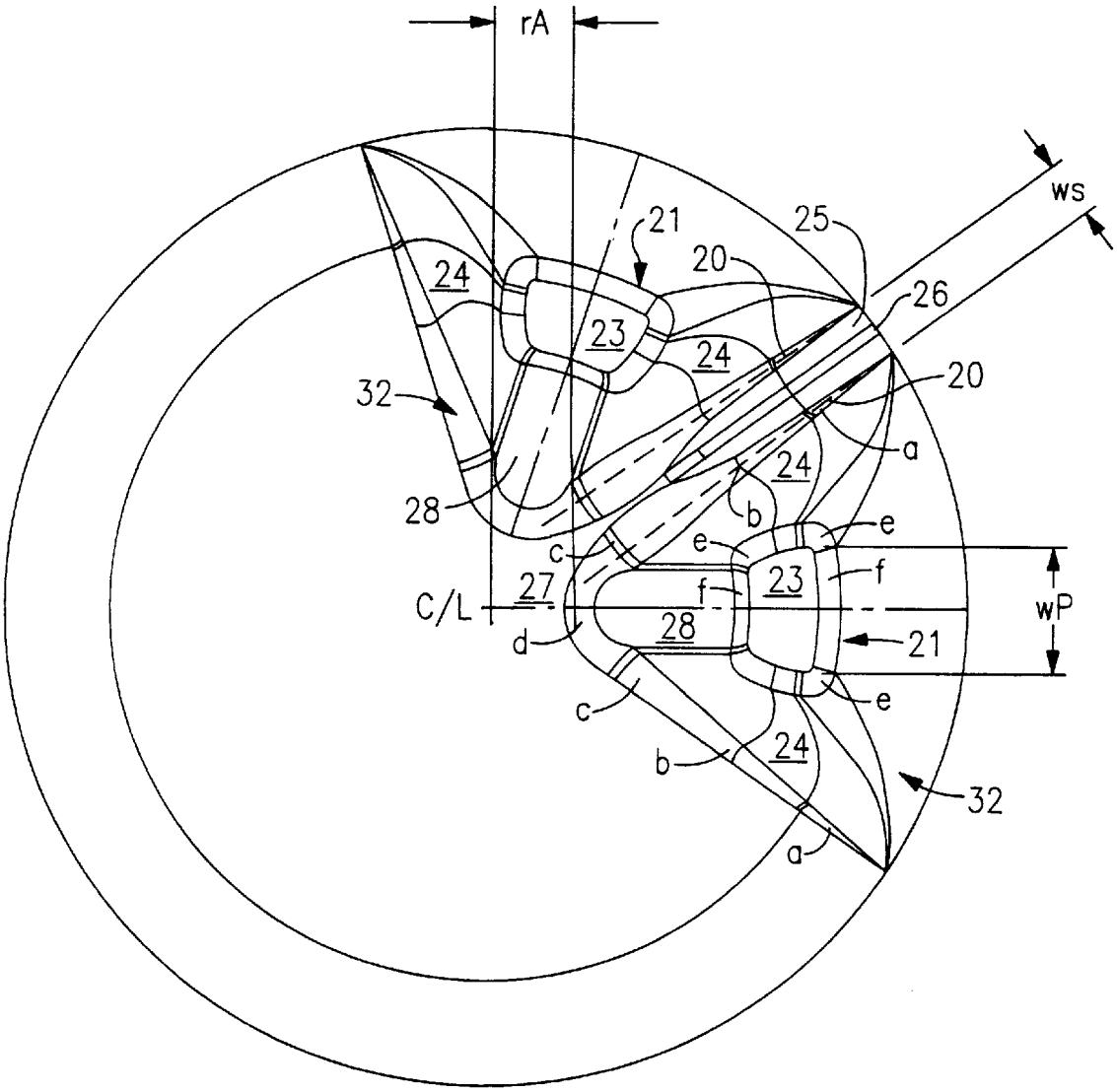
FIG. 4 is a diagrammatic view of the base illustrated in FIG. 3 again with three of five feet omitted.

The radially extending straps 25 are disposed between adjacent pairs of feet 21. These straps 25 each include flat strap root portions 26 but otherwise substantially follow the surface curvature of the underlying modified hemispherical shape 20 of the base. The straps 25 each terminate at and open into an extended portion and meet a sloping wall. The extended portion and sloping wall generally correspond to the portion 13 and wall 11 of FIG. 2. In FIG. 4, the theoretical underlying intersection of the straps 25 and walls 24 are shown by dashed lines 20 for one strap only. However, all straps are the same.

The base area 27, through which extends the axis 22 is connected to each pad 23 by a ridge ankle 28 joined on either side by blending curves to portions of the sloping walls 24.

Although shown in FIGS. 4, 5 and 6 by solid lines, for simplicity, at the junctions between the sloping side walls 24 and the straps 25 and pads 23, and between the ankles 28 and base area 27, the intersection of these elements are curved in cross-section to provide smooth transitions to and structural rigidity.

The bottle illustrated includes a small annular lip 30 which is primarily present for aesthetic purposes and for label alignment during production. This lip lies adjacent the transition from the sidewall to the base.

The radius rA of the base area 27 is critical to the bases resistance to rollout while minimize material usage. The base area 27 preferably has radius of 0.38 inches (9.65 mm) measured from axis 22 to the root of the ankles 28. The strap root 26 of each strap is coincident with the underlying base form 20.

It should be noted that dimensions and curvatures of the base set forth herein refer to the external surface of the base.

The sidewalls 24 and the ankles 28 of the feet 21 blend with the roots 26 and the base area 27 respectively by the use of a radiused curvature 31 which is concave. The curvature 31 increases in its cross-sectional radius (i.e. radius transverse of the length of the curvature 31) from the greatest base radius of the straps 25 to the base area 27. This is best seen in FIG. 6 in which the increasing radius of the curvature 31 is referenced a, b, c and d for one only of the feet 21. However, all of the feet and their interrelationship with other elements of the base are identical. In a 2 liter bottle the radii a, b, c and d are:

| | In the Range | | Preferably | |
|---|---|---|---|---|
| | inches | mm | inches | mm |
| a | 0.02–0.04 | 0.51–1.02 | 0.03 | 0.76 |
| b | 0.10–0.20 | 2.54–5.08 | 0.15 | 3.81 |
| c | 0.25–0.35 | 6.35–8.89 | 0.30 | 7.62 |
| d | 0.35–0.45 | 8.89–11.43 | 0.40 | 10.16 |

Preferably the radiused curvatures 31 increase continuously from a to d. The radiused curvatures 31 and curvatures e and f smoothly blend with associated surfaces of the base. It will be noted that the radiused curvatures 31 along opposite sides of each foot, blend seamlessly together in the junction between the ankle 25 of that foot and the base area 27.

The radiused curvatures 31 of adjacent feet never meet and thus the roots 26 of the straps 25 are continuous throughout their length. In fact the circumferential width g of each root about axis 22 is preferably no less then 0.03 inches (0.76 mm) while a width g in the range 0.02–0.04 inches (0.51–1.02 mm) is satisfactory. The minimum width g is located adjacent the radially inner extent of the sidewall relative to the axis 22. As can be seen from FIG. 5 the roots 26 are relatively wide at the outer radius of the base and narrow progressively to width g at which location the root width remains substantially constant until the root progressively widens to join the base area 27.

The pads 23 are blended into the sidewalls 24, ankles 28 and outer walls 32 by curvatures e and f which are convex, as seen from the outside of the base, the radii being

| | In the Range | | Preferably | |
|---|---|---|---|---|
| | inches | mm | inches | mm |
| e | 0.100–0.150 | 2.54–3.81 | 0.125 | 3.18 |
| f | 0.125–0.175 | 3.18–4.45 | 0.150 | 3.81 |

The ankles 28 have a concave curvature, along a radius of the base of approximately 2.00 inches (50.80 mm).

The sidewalls 24 preferably have a compound convex curvature having radii varying from about 2.1 to about 2.3 inches (53.34–58.42 mm), for example.

Utilizing the geometry and dimensions of the present invention, a petaloid base of a two liter bottle has been shown to perform acceptably at a weight of 14 grams of PET as opposed to the currently used petaloid bases which have a weight of approximately 17 grams of PET. It is expected that weights of 12.5 grams or even 12.0 grams can be achieved in bases according to the present invention when blown from conventional preforms and even lower, perhaps 11.5 grams, when blown from a monofoot preform such as those described and illustrated in the inventors own U.S. Pat. Nos. 4,780,257, 4,889,752 and 4,927,679.

Figure 7:
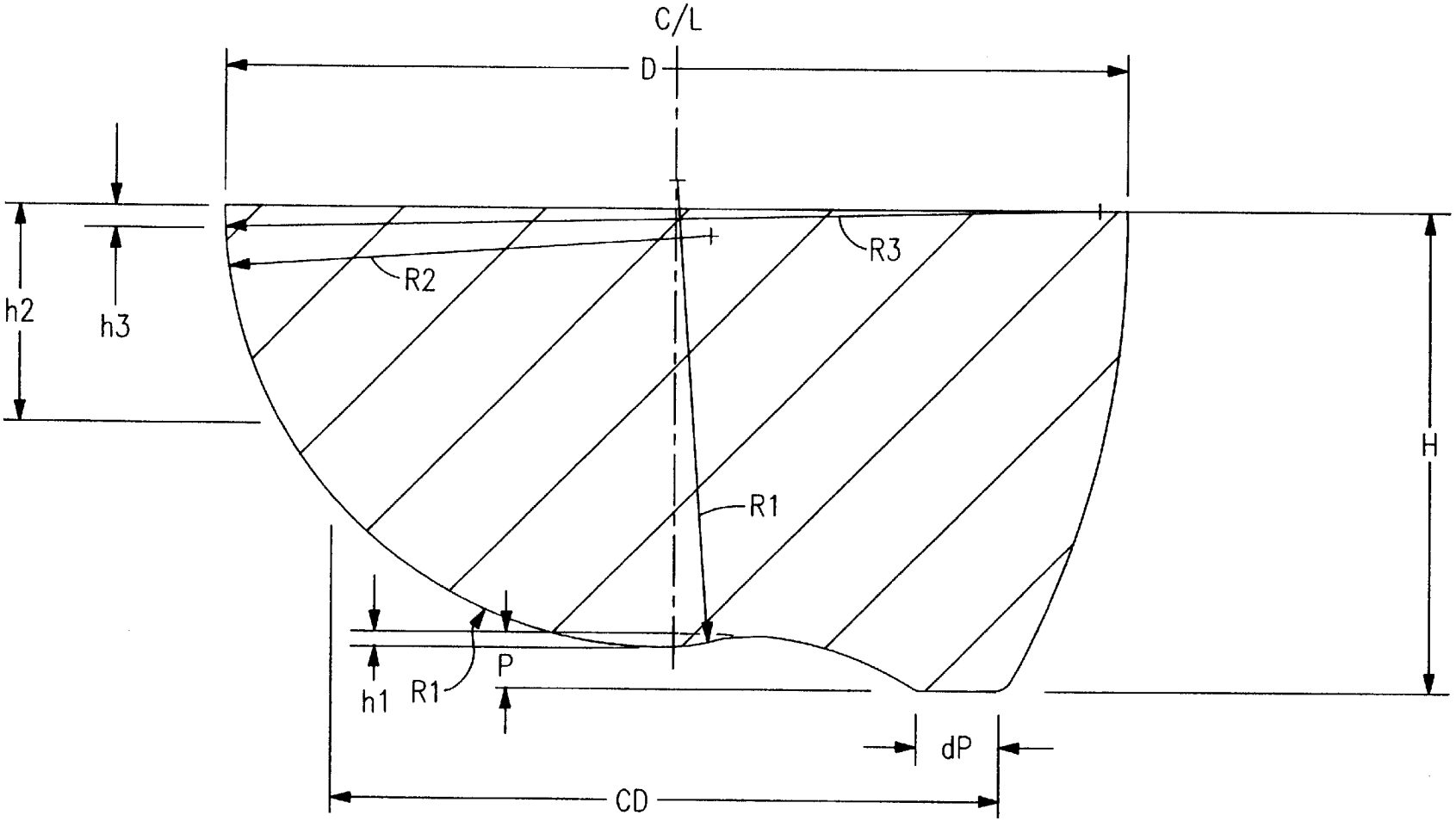
FIG. 7 is a diagrammatic fragmentary cross-section of the base of the present invention taken through the modified hemispherical base form and one foot.

With reference to FIGS. 4 and 7, the following table sets forth preferred dimensions for the modified hemispherical base form of 20 ounces, 1 liter, 2 liter and 3 liter bottles according to the present invention.

IN INCHES

| Bottle Size<br>Variable Nomenclature | 20 oz. | 1 liter | 2 liter | 3 liter | Range |
|---|---|---|---|---|---|
| H | 1.3 | 2.0 | 2.5 | 2.6 | max |
| ht of base | 1.0 | 1.6 | 2.2 | 2.0 | Nominal |
| supplied by customer | 0.9 | 1.4 | 1.6 | 1.7 | min |
| D | 3.0 | 3.6 | 4.7 | 5.3 | max |
| dia base | 2.7 | 3.2 | 4.3 | 4.9 | Nominal |
| supplied by customer | 2.4 | 2.8 | 4.0 | 4.3 | min |
| CD | 2.4 | 2.7 | 3.3 | 4.0 | max |
| contact dia | 2.0 | 2.5 | 3.0 | 3.6 | Nominal |
| | 1.9 | 2.2 | 2.6 | 3.1 | min |
| P | 0.22 | 0.28 | 0.31 | 0.32 | max |
| push up | 0.19 | 0.23 | 0.28 | 0.28 | Nominal |
| | 0.15 | 0.19 | 0.22 | 0.23 | min |
| $R_1$ | 1.8 | 1.9 | 2.9 | 3.2 | max |
| bottom parabola rad | 1.4 | 1.6 | 2.2 | 2.6 | Nominal |
| from print | 1.2 | 1.4 | 1.7 | 2.0 | min |
| $R_2$ | 4.2 | 4.4 | 4.5 | 4.6 | max |
| middle parabola rad | 2.2 | 1.7 | 2.3 | 3.3 | Nominal |
| | 1.5 | 1.5 | 1.6 | 1.7 | min |
| $R_3$ | 3.6 | 4.6 | 4.5 | 4.6 | max |
| top rad | 2.0 | 4.4 | 4.1 | 3.4 | Nominal |
| | 1.0 | 2.0 | 2.8 | 2.9 | min |
| $h_3$ | 0.09 | 0.10 | 0.12 | 0.13 | max |
| ht rad 3 | 0.05 | 0.09 | 0.09 | 0.09 | Nominal |
| | 0.02 | 0.05 | 0.05 | 0.05 | min |
| $h_2$ | 0.80 | 1.10 | 1.50 | 1.60 | max |
| ht rad 2 tangent | 0.54 | 0.83 | 1.14 | 1.15 | Nominal |
| from print | 0.45 | 0.50 | 0.75 | 0.85 | min |
| $h_1$ | 0.04 | 0.05 | 0.05 | 0.05 | max |
| ht rad 1 off set | 0.02 | 0.03 | 0.03 | 0.02 | Nominal |
| | 0.01 | 0.01 | 0.01 | 0.01 | min |
| rA | 0.40 | 0.45 | 0.50 | 0.50 | max |
| rad to ankle | 0.28 | 0.38 | 0.38 | 0.38 | Nominal |
| transition | 0.20 | 0.25 | 0.30 | 0.30 | min |
| wP | 0.45 | 0.50 | 0.80 | 0.90 | max |
| width foot pad | 0.35 | 0.37 | 0.55 | 0.57 | Nominal |
| | 0.20 | 0.26 | 0.35 | 0.40 | min |
| dP | 0.35 | 0.40 | 0.43 | 0.60 | max |
| depth foot pad | 0.28 | 0.31 | 0.33 | 0.46 | Nominal |
| | 0.15 | 0.25 | 0.28 | 0.30 | min |

-continued

IN INCHES

| Bottle Size Variable Nomenclature | 20 oz. | 1 liter | 2 liter | 3 liter | Range |
|---|---|---|---|---|---|
| wS | 0.25 | 0.30 | 0.31 | 0.32 | max |
| width strap @ start | 0.18 | 0.26 | 0.26 | 0.26 | Nominal |
| | 0.10 | 0.20 | 0.20 | 0.21 | min |
| H | 33.02 | 50.80 | 63.50 | 66.04 | max |
| ht of base | 25.40 | 40.64 | 55.88 | 50.80 | Nominal |
| supplied by customer | 22.86 | 35.56 | 40.64 | 43.18 | min |
| D | 76.20 | 91.44 | 119.38 | 134.62 | max |
| dia base | 68.58 | 81.28 | 109.22 | 124.46 | Nominal |
| supplied by customer | 60.96 | 71.12 | 101.60 | 109.22 | min |
| CD | 60.96 | 68.58 | 83.82 | 101.60 | max |
| contact dia | 50.80 | 63.50 | 76.20 | 91.44 | Nominal |
| | 48.26 | 55.88 | 66.04 | 78.74 | min |
| P | 5.59 | 7.11 | 7.87 | 8.13 | max |
| push up | 4.83 | 5.84 | 7.11 | 7.11 | Nominal |
| | 3.81 | 4.83 | 5.59 | 5.84 | min |
| $R_1$ | 45.72 | 48.26 | 73.66 | 81.28 | max |
| bottom parabola rad | 35.56 | 40.64 | 55.88 | 66.04 | Nominal |
| from print | 30.48 | 35.56 | 43.18 | 50.80 | min |
| $R_2$ | 106.68 | 111.76 | 114.30 | 116.84 | max |
| middle parabola rad | 55.88 | 43.18 | 58.42 | 83.82 | Nominal |
| | 38.10 | 38.10 | 40.64 | 43.18 | min |
| $R_3$ | 91.44 | 116.84 | 114.50 | 116.84 | max |
| top rad | 50.80 | 111.76 | 104.14 | 86.36 | Nominal |
| | 25.40 | 50.80 | 71.12 | 73.66 | min |
| $h_3$ | 2.29 | 2.54 | 3.05 | 3.30 | max |
| ht rad 3 | 1.27 | 2.29 | 3.39 | 2.29 | Nominal |
| | 0.51 | 1.27 | 2.37 | 1.27 | min |
| $h_2$ | 20.32 | 27.94 | 38.10 | 40.64 | max |
| ht rad 2 tangent from | 13.72 | 21.08 | 28.96 | 29.21 | Nominal |
| print | 11.43 | 12.70 | 19.05 | 21.59 | min |
| $h_1$ | 1.02 | 1.27 | 1.27 | 1.27 | max |
| ht rad 1 off set | 0.51 | 0.76 | 0.76 | 0.51 | Nominal |
| | 0.25 | 0.25 | 0.25 | 0.25 | min |
| rA | 10.16 | 11.43 | 12.70 | 12.70 | max |
| rad to ankle | 7.11 | 9.65 | 9.65 | 9.65 | Nominal |
| transition | 5.08 | 6.35 | 7.62 | 7.62 | min |
| wP | 11.43 | 12.70 | 20.32 | 22.86 | max |
| width foot pad | 8.89 | 9.40 | 13.97 | 14.48 | Nominal |
| | 5.08 | 6.60 | 8.89 | 10.16 | min |
| dp | 8.89 | 10.16 | 10.92 | 15.24 | max |
| depth foot pad | 7.11 | 7.87 | 8.38 | 11.68 | Nominal |
| | 3.81 | 6.35 | 7.11 | 10.16 | min |
| wS | 6.35 | 7.62 | 7.87 | 8.13 | max |
| width strap @ start | 4.57 | 6.60 | 6.60 | 6.60 | Nominal |
| | 2.54 | 5.08 | 5.08 | 5.33 | min |

In this table:

H is base height,

D is the major diameter of the bottle,

CD is the contact diameter of the outer extremities of the support pads of the feet, P is the pushup (i.e. the height of the center of the base above a support plane 42, $h_1$ is the height of the intersection of the base area and the curvature d above the pushup, $h_2$ is the height of the transition from $R_1$ to $R_2$ below the top of the base, $h_3$ is the height of the transition from $R_2$ to $R_3$ below the top of the base, $R_1$ is the lower radius of a vertical section of the modified hemispherical shape passing through container longitudinal axis C/L, $R_2$ is the intermediate radius of a vertical section of the modified hemispherical shape passing through container longitudinal axis C/L, $R_3$ is the upper radius of a vertical section of the modified hemispherical shape passing through container longitudinal axis C/L, rA is the radius from the bottle axis to the transition from the base area 27 to the ankle 28 underlying the curved transition d, wP is the circumferential contact width of the foot pad, dP is the radial depth of the foot pad, wS is the circumferential width of the strap at the radially outer extension thereof.

It will be appreciated that all horizontal sections of the underlying modified hemispherical base are circular and that all vertical sections thereof passing through axis C/L(FIG. 7) are identical with radii $R_1$, $R_2$, and $R_3$, heights $h_2$ and $h_3$ defining the transitions between the radii. Further, these radii and heights together with the origins of the radii are chosen so that the tangents of intersecting radii are coincident at the transitions therebetween.

The following table illustrates some ratios between dimensions in this last table.

| | | | | | |
|---|---|---|---|---|---|
| $R_1$ % of D | 120 | 106 | 125 | 121 | max |
| (%) | 105 | 102 | 101 | 103 | Nominal |
| calculated | 100 | 100 | 85 | 93 | min |
| $h_2$ % of (H—P) | 74 | 64 | 70 | 70 | max |
| (%) | 64 | 59 | 59 | 66 | Nominal |
| calculated | 60 | 41 | 54 | 58 | min |

The above ratios include a maximum to minimum ratio as well as a nominal ratio.

In addition to the aforementioned features of the base of the present invention, an important aspect is the shape and circumferential cross-section of material about axis 22 through the ankles 28 and straps 25 during the blow molding process. This cross-section is arranged to provide as large as possible circumferential cross-section in the ankle area to promote material flow, during molding, into the pad and adjacent other foot portions. However this must be balanced against providing sufficient corresponding cross-section in the straps to promote sufficient material flow, during molding, to the radially outer reaches of the straps and throughout their length in order to provide desired strength of the straps, and each ankle and strap should have a circumferential cross-section to promote material flow, during formation by blow molding of the container from a preform, to provide desired strength in outer areas of the pads and radially outer reaches of the straps when combined with appropriate temperature conditioning of the perform, as conventionally known, prior to blow molding of the container. By the appropriate balancing of these circumferential cross-sectional features the base weight can be minimized while the necessary strength in the outer pad areas and associated foot walls can be achieved with associated reduction or elimination of stress cracking with less whitening and improved thermals (high temperature functioning) in the feet.

The design philosophy of a base according to the present invention to a customer's requirements requires the customer to define bottle capacity, base height H and major base diameter D, handling requirements and bottle performance specifications.

The designer now determines the contact diameter CD, pushup P, width of foot pad wP and depth dP of the foot pad according to handling requirements and bottle specifications.

$R_3$ is now created by an arc running tangent to the major diameter of the lower panel of the bottle, at the intersection of the lower panel and base major diameter, and ending at the foot pad near the contact diameter CD such that a fillet blending radii may run tangent to it and the foot pad.

The strap of the container, with centerline 36° from the center of the foot in a five footed base, is composed of radius' one, two, and three. Radius one $R_1$ is a calculated value amounting to between 85%–125% of half the major diameter D. $R_1$ runs horizontally through the centerline of the pushup P of the base and proceeds upward toward the major diameter D of the base. Extension beyond the centerline of the pushup on the opposing side of the strap ends when the vertical distance $h_1$ to the pushup P is between 0.01"–0.05".

$R_2$ is derived by defining its tangent point with radius one $R_1$ and its end point or intersection with radius three $R_3$. The tangent point is defined by its vertical distance $h_2$ from the major diameter D and is a calculated value between 40%–80% of the difference between the height H and the pushup P.

The horizontal radius rA from the centerline of the pushup P to the intersection of the ankle radius and $R_1$ is assigned a value between 0.2" and 0.5". This defines the sharp intersection which the variable radii fillets.

The width of the underlying strap wS, which is composed of parallel lines is based upon the major diameter D and number of feet. It ranges between 0.1" and 0.32".

The remaining features of the base tend to be driven by fixing the aforementioned variables.

In preparation for blow molding it is important to ensure that the preform is temperature conditioned, appropriately stretched and positioned in the blow mold to contact the blow mold in the strap areas in a timely manner to produce desired material distribution. If the contact is too soon the material will cool too quickly and will be too thick and vice-versa.

As is well known by those skilled in the art, preferred performance is obtained in PET containers by providing desired axial and hoop stretching of the material during the blow molding process thus bi-axially orienting the material of the container. The above-described temperature conditioning and stretching coupled with the blow molding itself provide desired bi-axial orientation of the material together with accurate placement thereof to form the light weight petaloid base and container of the present invention.

When the blowing is complete, a container with the base of the present invention, in the form of a bottle is produced having a base of less weight than prior art petaloid bases while maintaining adequate strength to withstand internal pressure from a carbonated beverage. The base of the bottle comprises all of the features of the prior art bottles to facilitate standing.

While the preferred base of the present invention has five feet, it will be appreciated that the concepts of the present invention are applicable to bases having three or more feet.

We claim:

1. A self-standing polyester container for carbonated beverages defining a longitudinal axis and comprising a sidewall portion which is integral with and terminates in a closed base of a petaloid form having an underlying base form with at least three feet depending therefrom and disposed about the longitudinal axis whereby the container is self standing, each said foot being defined by: i) a support pad; ii) a sloping outer wall extending radially outward from said axis and upward from an outer circumferential convex edge of the support pad to the sidewall portion; iii) sloping side walls each extending upward from circumferential convex side edges of the support pad, each of said sloping side walls extending radially from said axis to a transition between each sloping side wall and an associated strap; each strap being disposed between adjacent pairs of feet and extending radially outward from a base area, centered on said longitudinal axis, toward said sidewall portion, the straps and the base area conforming to the underlying base form; iv) a sloping ankle extending inward and upward from an inner circumferential convex edge of the support pad to a junction with the base area; and, v) blending concave curvatures, wherein each of said blending concave curvatures forming the transition of each said sloping side wall and associated strap of each foot, and extending from adjacent a radially outermost extension of the associated strap to a circumferential center of the junction of the associated ankle and the base area, said blending concave curvatures increasing in radius transversely of the curvature from its radially outermost extension to the circumferential center of the junction of the associated ankle and base area at which said blending concave curvatures smoothly joins each other.

2. A container according to claim 1 having five said feet, the pads of which define a support plane.

3. A container according to claim 2, wherein said transverse radius of said blending concave curvature increases from a range of about 0.02 inches to about 0.04 inches to a range of about 0.35 inches to about 0.45 inches.

4. A container according to claim 2, wherein the transverse radius of each blending concave curvature increases continuously.

5. A container according to claim 2 in the form of a two-liter bottle for carbonated beverages wherein the base has a height H above a surface, supporting the bottle, of from about 1.6 inches to about 2.5 inches and a weight of no more than about 14 grams.

6. A container according to claim 2, wherein a minimum width of each strap is in a range of about 0.02 inches to about 0.04 inches.

7. A container according to claim 6, wherein the minimum width is adjacent radially, relative to the longitudinal axis, inner portions of the sidewalls.

8. A container according to claim 2, wherein the underlying base form opposed each said feet and starting at said base portion is a paraboloid centered on the longitudinal axis with the radius of the paraboloid along the longitudinal axis being smaller than the radius normal to that axis at the radially outermost extent of the base form.

9. A container according to claim 2, wherein said closed base is in a modified hemispherical shape, circular normal to said longitudinal axis, said base having a major diameter D normal to said longitudinal axis and a height H, along said longitudinal axis, said modified hemispherical shape being defined by radii, $R_1$, $R_2$ and $R_3$ and heights $h_2$ and $h_3$ where;

$R_1$ is the lower radius in a vertical section, centered on the longitudinal axis, of the modified hemispherical shape and forms a smooth transition with $R_2$ at height $h_2$ below height H;

$R_2$ is an intermediate radius in a vertical section, passing through the longitudinal axis, of the modified hemispherical shape and forms a smooth transition with $R_3$ at height $h_3$ below height H; and $R_3$ is the upper radius in a vertical section, passing through the longitudinal axis, of the modified hemispherical shape and forms a smooth transition with said sidewall portion at height H; wherein a) for a container in the form of a 20 ounce bottle, $R_1$ is about 1.2 inches to about 1.8 inches, $R_2$ is about 1.5 inches to about 4.2 inches, $R_3$ is about 1.0 inches to 3.6 inches;

b) for a container in the form of a 1 liter bottle, $R_1$ is about 1.4 inches to about 1.9 inches, $R_2$ is about 1.5 inches to 4.4 inches, $R_3$ is about 2.0 inches to about 4.6 inches;

c) for a container in the form of a 2 liter bottle, $R_1$ is about 1.7 inches to about 2.9 inches, $R_2$ is about 1.6 inches to 4.5 inches, $R_3$ is about 2.8 inches to about 4.5 inches;

d) for a container in the form of a 3 liter bottle, $R_1$ is about 2.0 inches to about 3.2 inches, $R_2$ is about 1.7 inches to 4.6 inches, $R_3$ is 2.9 inches to about 4.6 inches; and $h_2$ and $h_3$ and the origins of $R_1$, $R_2$ and $R_3$ are chosen so as to provide a smooth transition between $R_1$ and $R_2$ and between $R_2$ and $R_3$.

10. A container according to claim 9, wherein $R_1$ is about 85% to about 125% of diameter D.

11. A container according to claim 9, wherein a pushup P is the height of the center of the base area above said support plane within the range of about 0.15 to about 0.32 inches; and h2 is within the range of about 41% to about 74% of H minus P.

12. A container according to claim 9, where a pushup P is the height of the center of base above the support plane and $h_1$ is the greatest height of the blending concave curvatures at the intersections of the base area and the ankles above height P; wherein a) for a container in the form of a 20 ounce bottle, $h_1$ is about 0.01 inches to about 0.04 inches and;

b) for a container in the form of a 1, 2, and 3 liter bottle, $h_1$ us about 0.01 inches to about 0.05 inches.

13. A container according to claim 12, where $R_1$ is about 85% to about 125% of diameter D and a pushup P is the height of the center of the base area above said support plane within the range of about 0.15 to about 0.32 inches; and h2 is within the range of about 41% to 74% of H minus P.

14. A container according to claim 2, wherein said closed base is in a modified hemispherical shape, said base having a major diameter D and a height H, said modified hemispherical shape being defined by radii, $R_1$, $R_2$ and $R_3$ and heights $h_2$ and $h_3$ where;

$R_1$ is the lower radius in a vertical section, centered on the longitudinal axis, of the modified hemispherical shape and forms a smooth transition with $R_2$ at height $h_2$ below height H;

$R_2$ is an intermediate radius in a vertical section, passing through the longitudinal axis, of the modified hemispherical shape and forms a smooth transition with $R_3$ at height $h_3$ below height H; and $R_3$ is the upper radius in a vertical section, passing through the longitudinal axis, of the modified hemispherical shape and forms a smooth transition with said sidewall portion at height H; wherein a) for a container in the form of a 20 ounce bottle, $h_2$ is about 0.45 to about 0.80 inches, $h_3$ is about 0.02 to about 0.09 inches;

b) for a container in the form of a 1 liter bottle, $h_2$ is about 0.5 to about 0.10 inches, $h_3$ is about 0.05 to about 0.10 inches;

c) for a container in the form of a 2 liter bottle, $h_2$ is about 0.75 to about 1.5 inches, $h_3$ is about 0.05 to about 0.12 inches;

d) for a container in the form of a 3 liter bottle, $h_2$ is about 0.85 to about 1.6 inches, $h_3$ is about 0.05 to about 0.13 inches; and $R_1$, $R_2$ and $R_3$ and their origins are chosen in such a manner as to ensure a smooth transition between $R_1$ and $R_2$ and between $R_2$ and $R_3$.

15. A container according to claim 14, where P is the height of the center of base above the support plane and $h_1$ is the greatest height of the blending concave curvatures at the intersections of the base area and the ankles above height P; wherein a) for a container in the form of a 20 ounce bottle, $h_1$ is about 0.01 inches to about 0.04 inches and;

b) for a container in the form of a 1, 2, and 3 liter bottle, $h_1$ us about 0.01 inches to about 0.05 inches.

16. A container according to claim 15, where $R_1$ is about 85% to about 125% of diameter D and a pushup P is the height of the center of the base area above said support plane within the range of about 0.15 to about 0.32 inches; and $h_2$ is within the range of about 41% to about 74% of H minus P.

17. A container according to claim 2, where pushup P is the height of the center of base area above the support plane and $h_1$ is the greatest height of the blending concave curvatures at the intersections of the base area and the ankles above height P; wherein a) for a container in the form of a 20 ounce bottle, $h_1$ is about 0.01 inches to about 0.04 inches and;

b) for a container in the form of a 1, 2, and 3 liter bottle, $h_1$ is about 0.01 inches to about 0.05 inches.

18. A container according to claim 1, wherein each ankle and strap have a circumferential cross-section to promote material flow, during formation by blow molding of the container from a perform, to provide desired strength in outer areas of the pads and radially outer reaches of the straps when combined with appropriate temperature conditioning of the perform prior to blow molding of the container.

* * * * *